US005492330A

United States Patent [19]

Eldridge, Jr. et al.

[11] Patent Number: 5,492,330

[45] Date of Patent: Feb. 20, 1996

[54] GOLF TRAINING DEVICE

[76] Inventors: Eugene Eldridge, Jr., 1766 S. Main St., Salt Lake City, Utah 84115; Scott T. Dennis, 9714 S. 2720 E., Sandy, Utah 84119; Robert B. Breck, 3285 S. Hillsdale Dr., West Valley City, Utah 84119

[21] Appl. No.: 368,484

[22] Filed: Jan. 4, 1995

[51] Int. Cl.[6] ..... A63B 57/00

[52] U.S. Cl. ..... 273/187.1; 273/32 B; 273/163 R

[58] Field of Search ..... 273/187.1, 32 R, 273/32 B, 32 H, 163 R

[56] References Cited

U.S. PATENT DOCUMENTS

| | | | |
|---|---|---|---|
| 2,862,714 | 12/1958 | Smith | 273/183 |
| 2,934,348 | 12/1960 | Magida | 273/183 |
| 3,202,700 | 8/1965 | Kaczka | 260/482 |
| 3,203,700 | 8/1965 | Antonious | 273/32 B X |
| 3,899,179 | 8/1975 | Vlach | 273/183 A |
| 3,934,882 | 1/1976 | Whittaker | 273/183 A |
| 4,151,990 | 5/1979 | Josenhans | 273/2 |
| 4,913,440 | 4/1990 | Ellington | 273/186 R |
| 5,240,254 | 8/1993 | Adlam | 273/187.1 |

*Primary Examiner*—William H. Grieb
*Attorney, Agent, or Firm*—Madson & Metcalf

[57] ABSTRACT

A golf training device is shown. The golf training device includes means for attaching the invention to a golf tee, while allowing a golf ball to rest on the tee. The golf training device includes a sighting mechanism to allow the user to align the invention with a target some distance away. The device also has extensions, such that when a golf ball is struck, the extensions are struck. Examination of the extensions after the invention has been struck gives a golfer feedback concerning the location and angle of his or her club face at the moment of impact with the ball.

18 Claims, 5 Drawing Sheets

GOLF TRAINING DEVICE

BACKGROUND

1. The Field of the Invention

The present invention is related to a golf training device. More particularly, the present invention is related to a novel training device which is configured such that it is capable of aiding alignment of a golf shot and providing feedback after the golf swing.

2. Technical Background

More people have taken up the game of golf in recent years than at any time previously. With the increase in number of public courses, the game of golf has become available to almost everyone. The golf craze has affected every age group and every level of society. No matter what the skill level of the golfer, every golfer's objective is to lower their score, their frustration with the game, or both.

The frustration and higher scores can be attributed to many sources. One such source is that the game of golf looks and appears to be so much easier to play than it actually is. Golfers often approach a golf shot with the idea that they will swing the club and the ball will travel with perfect trajectory and accuracy toward the predetermined target. All to often, however, the ball hooks, slices, or dribbles forward an unacceptably short distance. When the reality of the actual golf shot does not match the golfer's preconceived image of that shot, frustration results.

The trajectory, accuracy, and distance in which a golf ball travels on any given shot is a function of how the club face impacts the ball. If the angle of impact is askew, the ball may hook or slice. Likewise, if the club does not impact the ball squarely, unwanted results may occur. For example, if only the very end of the club impacts the ball, the ball will travel in a sharp angle away from the golfer. Additionally, if only the very bottom of the club hits the ball, a phenomenon known as topping the ball occurs. Topping the ball drives it into the ground, significantly reducing the distance that the ball travels.

In response to the desire to lower scores and frustration levels, a variety of golf training devices have been developed. Such devices include tee attachments with markers to help align the golf shot. Other devices help position the club face when addressing the ball. Still others aid in positioning the golfer's feet when hitting a golf shot. There are also golf devices which help train a golfer's swing.

One disadvantage of conventional golf devices is that they do not offer feedback about club angle and location and the critical moment of impact with the golf ball. Many golfers will position the club face correctly at the start of the shot, only to slightly rotate or reposition the club during the swing. Thus, at the critical moment of impact, the club angle or location is in an undesired, yet unknown position, adversely affecting the golf shot.

Another difficulty with conventional training devices is that they are often complex, cumbersome, or heavy. Many devices have bases with adjustable pegs or mats with rubber tees. If a golf device is too large, bulky, or complex, it is far less likely to be used.

Yet another disadvantage associated with many golf devices is that they can only be used by right- or left-handed golfers, but not both. Further, some devices can only be used with a tee. Some devices cannot be used with a tee. This limits where the device can be used. Thus, many conventional golf devices are only useful for certain shots by certain people.

From the foregoing, it will be appreciated that it would be an advancement in the art to provide an improved golf training device that would offer feedback concerning the angle and location of the golf club face at the critical moment of impact.

It would be a further advancement in the art to provide a golf device that is simple, light, and compact enough to fit into the pocket of a golfer.

It would be an additional advancement in the art to provide a golf device that could be used by both right- and left-handed golfers.

It would be still a further advancement in the art if the device could be used with or without a golf tee.

Finally, it would be an additional advancement in the art if the golf training device offered feedback and convenience in combination with a sighting means to align the golf shot.

Such a golf training device is disclosed and claimed herein.

BRIEF SUMMARY OF THE INVENTION

The present invention is directed to a novel golf training device. In a preferred embodiment, the invention includes means for attaching the invention to a golf tee, while allowing a golf ball to rest on the tee. The invention has a sighting mechanism to allow the user to align a golf shot with a preselected target some distance away. The invention also has means for providing the user with feedback concerning club location and angle of impact with the ball. This combination of features in a simple device provides a significant improvement over conventional golf training devices.

As mentioned above, the golf training device comprises means for attachment to a golf tee. A typical golf tee consists of shaft with a point on one end to facilitate securing the tee in the ground. At the other end of the shaft, the tee flares out to a cup whereon a golf ball may rest. The means of attachment may consist of a substantially circular opening through which the shaft of a golf tee may pass. The device provides versatility in that it can be releasably secured to the cup of the tee or rest on the ground about the shaft of the tee. When the golf device is resting on the ground, the boundary of the opening completely or substantially surrounds the shaft of the tee, albeit not in direct contact with the tee. Thus "attachment," as used herein, not only refers to literal attachment, but is also used to describe the positioning of the golf device around the tee so as to maintain the general position of the device in relation to the tee.

The sighting mechanism of the golf device may be a projection which facilitates alignment of a golf shot. In one embodiment, the projection is notched or grooved so that the sighting mechanism is similar to that of a gun site. The groove is positioned on an axis running through the middle of the attachment opening or hole. In this configuration, after the golfer aligns the shot, the device can be placed on the ground with the sighting mechanism projection pointing toward the target. Because the golf tee will necessarily be positioned or secured along the previously mentioned axis, the ball will be aligned with the sighting mechanism and the preselected target. The sighting mechanism of this golf device is an improvement over those of conventional devices.

The golf device also comprises a mechanism for providing feedback to a golfer. The feedback mechanism may include a number of outwardly projecting extensions which may be in a variety of shapes. The extensions are configured such that when a golf ball resting on a tee attached to the golf training device is struck, the extensions are also struck. Upon impact, the extensions deform. Because the feedback extensions are aligned normally to the above mentioned axis, and are substantially similar to each other, the angle and location of club impact can be determined by examining the deformations. The novel combination of an improved sighting mechanism with the unique ability to provide the golfer with feedback is an advancement over other conventional golf devices.

The golf training device may be made from a single piece of lightweight material such as plastic, rubber, wood, paper, or any number of composites or other materials. It one embodiment, it is small enough to fit into a golfer's pocket. Further, it can be used without modification by right- or left-handed golfers. This convenience represents a significant improvement over conventional golf devices.

The advantage of this golf device lies in the improved training provided by an advanced sighting mechanism coupled with a feedback mechanism that will provide a golfer with club position information at the critical moment of impact with the ball. This advantage is provided in a conveniently cost-effective device.

The objects and advantages of the present invention will become more fully apparent by examination of the following description of the preferred embodiments and the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
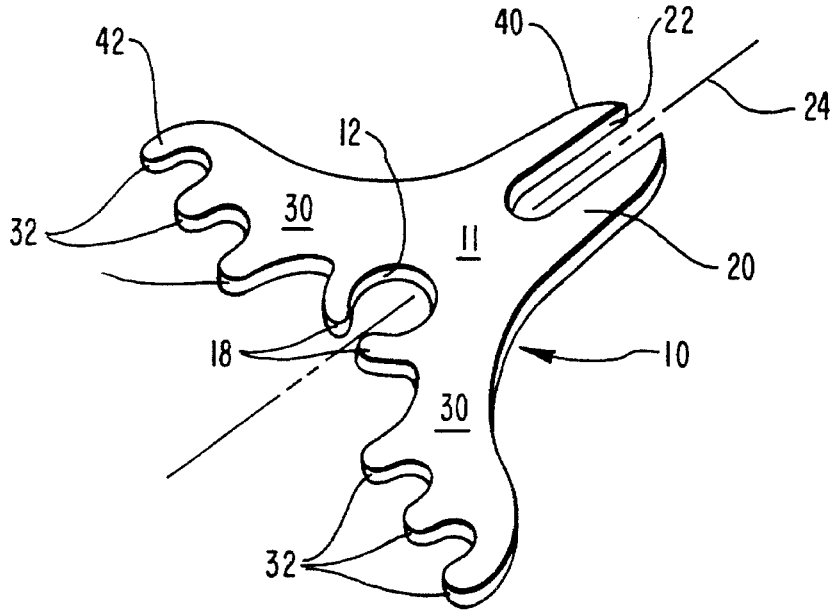
FIG. 1 is perspective view of one embodiment of the golf training device.

Reference is now made to the figures wherein like parts are referred to by like numerals throughout. With particular reference to FIG. 1, a golf training device according to the present invention is generally designated at 10. The golf training device comprises a body 11. The body 11 may be constructed from a single piece of lightweight material such as plastic, rubber, wood, paper, or any number of composites or other materials. It one embodiment, it is small enough to fit into a golfer's pocket. Further, it can be used without modification by right- or left-handed golfers.

The device 10 includes means for attachment to a golf tee. In a presently preferred embodiment, the attachment means consists of an opening 12 configured within body 11 such that the shaft of a golf tee may pass through the opening and be positioned in the opening while a golf ball rests on the tee. As illustrated in FIG. 1, the opening 12 disposed within the golf training device 10 is substantially circular. The diameter of the opening 12 is larger than the shaft of a golf tee and equal to or smaller than the cup of a golf tee. As illustrated in FIG. 1, the opening 12 has a boundary at least partially defined by two flexible projections 18. These projections 18 are slightly flexible and can be bent to allow slight expansion of the opening. This expandability permits the user to secure the golf training device 10 to the cup of a golf tee having an equal or slightly greater diameter than the opening.

It will be appreciated that there are a variety of alternative means for attaching the device and body 11 to a golf tee. One alternative method of attachment includes perforating the circumference of the opening through which the golf tee passes with spaced slits, allowing the opening to expand and attach to the tee. Alternatively, the golf training device may have a support or supports that allow the user to rest the ball on the golf training device without the need for a tee. The golf device may have supports and still be used with a tee, but without needing to be attached to the tee. It will also be appreciated by those with skill in the art that the opening may be circular or non-circular. Essentially, it is only necessary that adequate means be provided for limiting the movement of the device as it is used.

Referring still to FIG. 1, the golf training device 10 has a sighting mechanism comprising an indicator configured at the end of a projection 20 extending outwardly from the body 11. In the preferred embodiment, the indicator is a groove 22. However, it will be appreciated that in alternative embodiments the indicator may be a point, a notch, or any configuration that will facilitate aligning the golf training device with a target.

Figure 2:
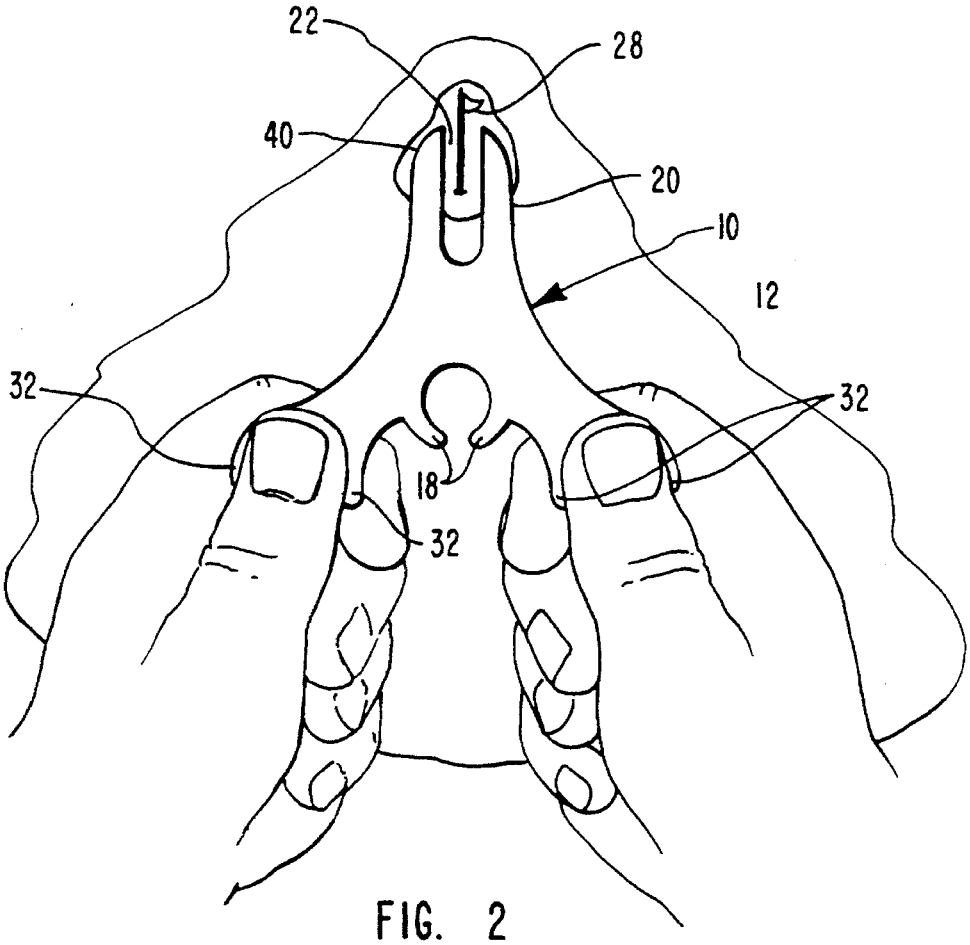
FIG. 2 is perspective view of the preferred embodiment being used to align a golf shot.

The device 10 has a longitudinal axis 24. The end of the sighting mechanism projection 20 and the center of the attachment mechanism opening 12 lie on the axis 24. Thus, when the golfer aligns a golf shot with the indicator which lies at the center of projections 20, as illustrated in FIG. 2, and tees up a ball with the projections 20 pointing towards the preselected target, the center of the opening 12 will also be aligned with the target. With the tee positioned in or attached to the device, the golf ball will be in line with the indicator and the target.

FIG. 1 also illustrates the feedback mechanism of the golf training device 10. The feedback mechanism 30 of the illustrated embodiment has extensions, configured such that when a golf ball resting on a tee attached to the golf training device 10, or on the device 10 itself, is struck by a golf club, the extensions are also struck. The extensions in the illustrated embodiment are prongs 32. The striking causes the prongs 32 to deform. The prongs 32 are configured such that by examining the deformed prongs, the golfer can tell the location and angle of club impact on the prongs 32, and consequently on the ball.

It will be appreciated that club angle and location are best detected if there are an equal number of feedback extensions similarly positioned behind each half of the golf ball. The extension in a preferred embodiment are prongs 32 possessing symmetry about the longitudinal axis 24. Because the center of the attachment opening 12 is on the longitudinal axis 24, there are an equal number of prongs 32 of substantially similar size and shape on each side of the longitudinal axis 24. Thus, if three prongs 32 are deformed on one side of the ball, but only one prong is deformed on the other side, the location of the club face upon impact with the prongs and the golf ball can easily be detected.

Angle detection is accomplished by comparing the angle of deformity of the prongs 32 to the original line established by the ends of the prongs before being deformed. Thus, in the presently preferred embodiment, the feedback mechanism prongs 32 extend outwardly in a direction parallel to the longitudinal axis 24 with each prong end aligned normally to the longitudinal axis 24.

It will be appreciated that at least two extensions, one on each side of the axis 24, are preferred to provide feedback concerning the angle of club impact on the prongs, and thus, the ball. It will further be appreciated, that the more extensions there are, the more accurate and useful the feedback will be. In the presently preferred embodiment there are three prongs 32 on each side of the axis 24. The prongs 32 on each side of the longitudinal axis 24 are equally spaced, each prong 32 having a length approximately twice its width. One with skill in the art will appreciate that in an alternative embodiment, the extensions may be triangular points or any type or shape of projection, such as will give the user accurate feedback after being struck.

The body 11, as illustrated in FIG. 1 has a generally triangular shape, with the sighting mechanism projections 20 and groove 22 positioned at one corner 40 of the triangular golf device 10 and the feedback mechanism extensions or prongs 32 positioned at the opposite base 42 of the generally triangular-shaped device 10. It will be appreciated that the teachings of this invention can be practiced with devices of various shapes and sizes.

As illustrated, the golf device 10 is comprised of a single planar body having uniform thickness. However, uniform thickness is not essential to practice the teachings of this invention. It should also be appreciated that the golf device 10 need not be planar.

To provide feedback, the golf device 10 must be made of a material that will allow deformity of the feedback extensions without allowing the golf training device 10 to splinter or shatter. In a presently preferred embodiment, the golf training device 10 is made of plastic. One of skill in the art will appreciate, however, that rubber, wood, paper products, metal, ceramic, composites, or other materials may be used to satisfy the teachings of this invention.

With reference now to FIG. 2, the first step in using the device is aligning the golf shot. This is best accomplished by holding the base end 42, with the feedback extensions 32 in a downward position. The ends of the extensions should be substantially parallel to the ground. The golfer then uses the groove 22 positioned at the end of the sighting mechanism projection 20 to align the device 10 with a preselected target 28.

The second step in using the device 10 involves attaching the device to a tee. As stated above, a typical tee has a shaft with a pointed end for placing the tee into the ground and a cup on which a golf ball may rest. The device 10 may be attached to a tee by placing it on the ground about the shaft of the tee 58 or by releasably securing it to the cup of the tee 60. It is important that the golfer maintain the position of the golf device 10 when attaching it to a tee so that the device 10 continues to point in the direction of the target 28.

Figure 3:
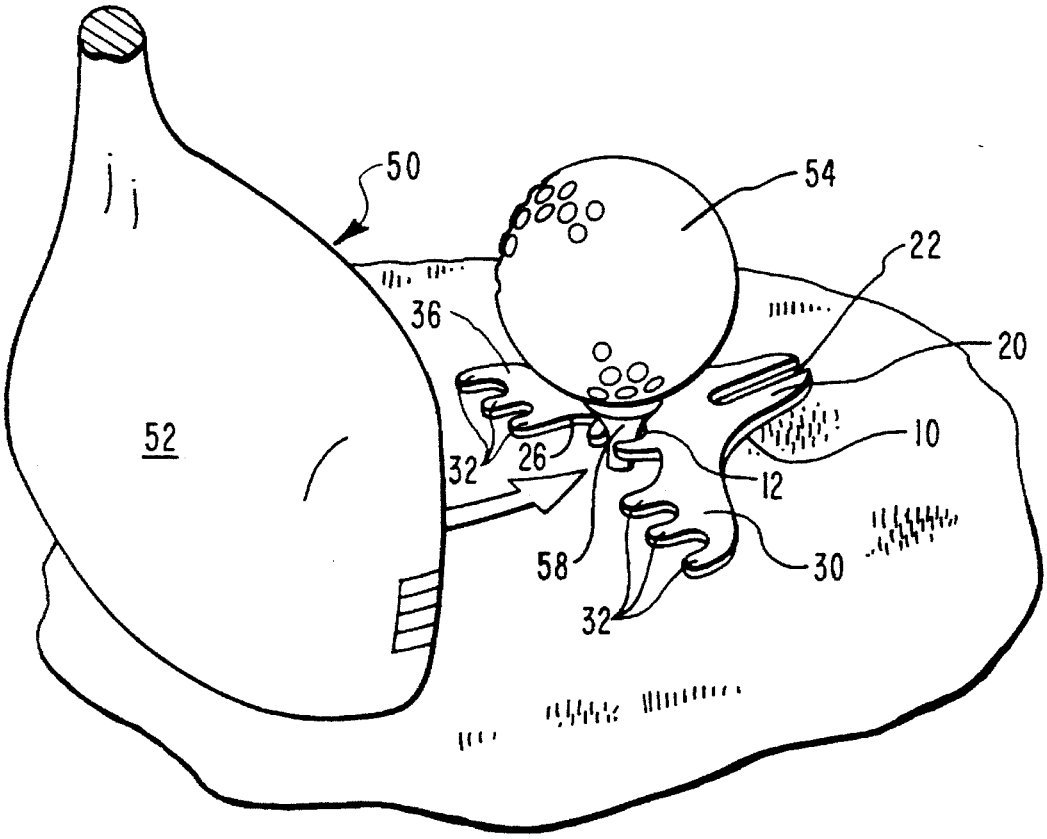
FIG. 3 is a perspective view of the golf training device attached to a golf tee with a golf ball and golf club.
Figure 3A:
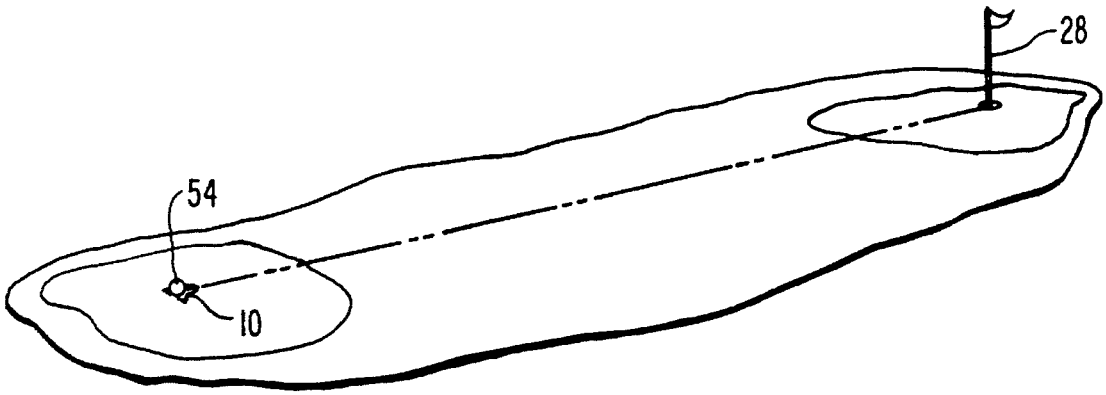
FIG. 3*a* is a perspective view of the preferred embodiment demonstrating how to use the golf training device after aligning the golf shot.

FIG. 3*a* illustrates the device 10 attached to a tee with a golf ball 54 resting on it. The device 10 has been used to align a golf shot with a target 28, and the device is maintained such that the sighting mechanism projection 20 is still pointing toward the target 28.

With reference now to FIG. 3, the golf training device 10 is shown attached to the shaft of a tee 58 with a golf ball 54 resting on the tee. As stated earlier, when the golf device 10 is resting on the ground, the boundary of the opening 12 is completely or substantially surrounding the shaft of the tee, albeit not necessarily in direct contact with the tee. Thus "attachment," as used herein, not only refers to literal attachment, but also describes the positioning of the golf device 10 around the shaft of a tee 58 so as to maintain the general position of the device in relation to the tee.

As further illustrated in FIG. 3, the club face 50 is aligned parallel to the ends of the extensions 32. In this position, the club face 50 is normal to the axis 24 and thus, pointed in the direction of the target 28. The next step requires the golfer to draw back the club 52 and swing it at the ball.

Figure 4:
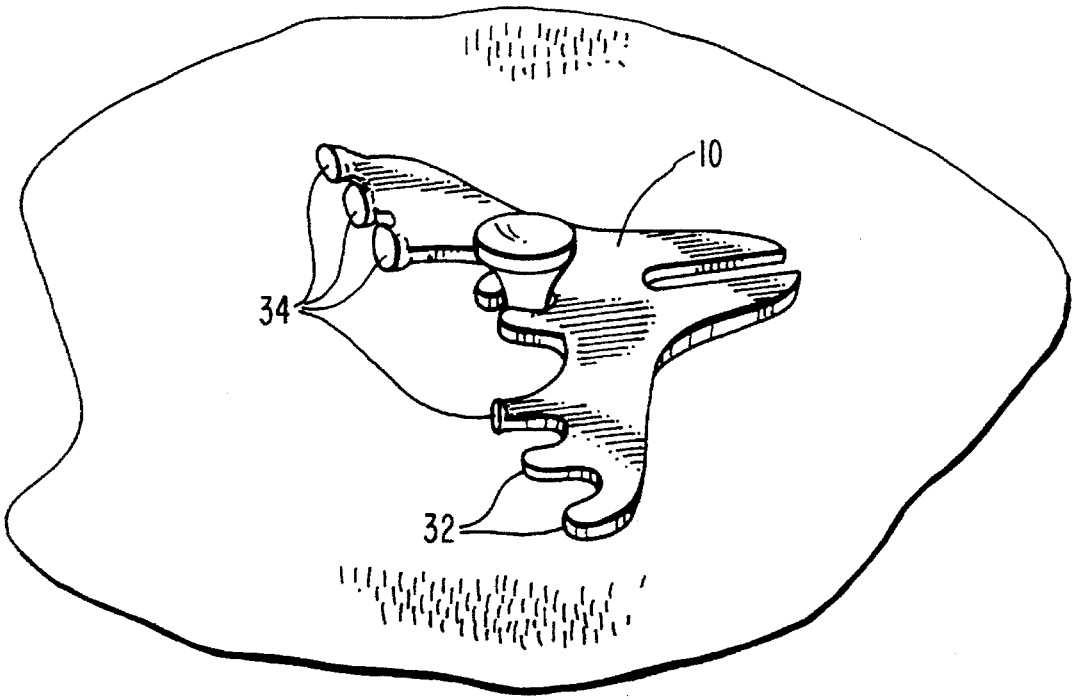
FIG. 4 is a perspective view of the golf training device of FIG. 1 after being struck by a golf club.

FIG. 4 illustrates the golf training device 10 after it has been struck by the club 52. The final step in using this device requires the golfer to examine the deformed prongs 34 which reveal the actual location and angle of impact, thus giving vital information on how the club struck the ball. FIG. 4 illustrates a decreasing level of feedback extension deformation starting with a deep deformation of the outer extension on one side. The adjacent extension is slightly less deformed and this pattern continues until the outer two extensions on the other side which are not deformed at all. Examining these deformations reveals that the club face struck the golf training device and consequently the ball at an angle. Had the golfer struck the golf ball squarely, the feedback extensions would have been equally deformed. Depending on the original location of the club face before the golf swing, the fact that only four of the six extensions were deformed reveals that the club moved away from a left-handed golfer or towards a right-handed golfer during the golf swing.

Figure 5:
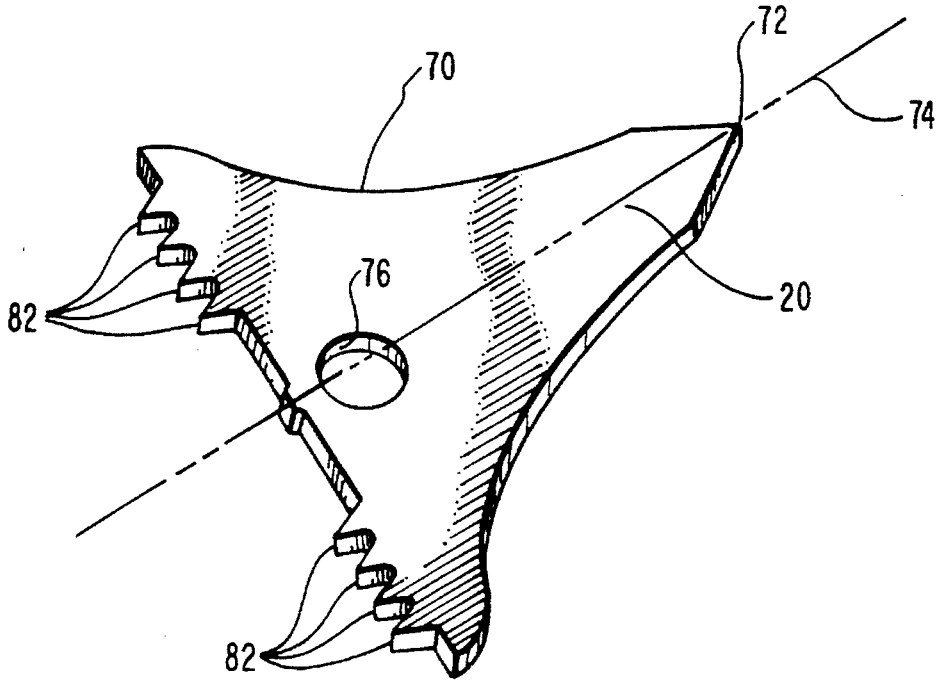
FIG. 5 is a perspective view of an alternative embodiment of the golf training device.

FIG. 5 illustrates an alternative embodiment of the golf training device designated 70. In this embodiment, the sighting indicator is a point 72. The indicator 72 is positioned on an axis 74. In this embodiment, the means for attachment is a circular hole 76 disposed within the devise 70. The center of the hole 76 also lies on the axis 74. It will be appreciated that a variety of shapes can be used to maintain the general position of the device 70 in relation to the golf tee. The feedback mechanism extensions illustrated in FIG. 5 are in the shape of triangular extensions 82. The extensions 82 are symmetrical about the axis 74. The ends of the extensions are aligned normally to the axis.

Figure 6:
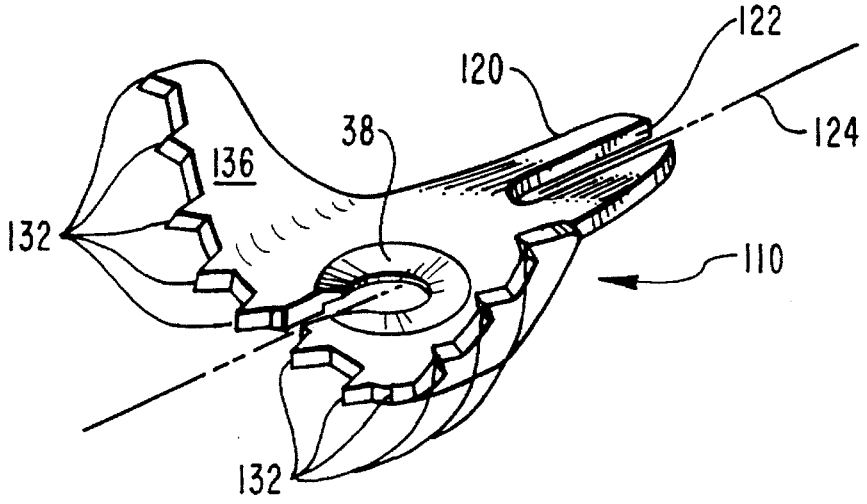
FIG. 6 is perspective view of another alternative embodiment of the golf training device.

With reference now to FIG. 6, another alternative embodiment generally designated 110 is shown. In this embodiment, the sighting mechanism projections 120 are configured with a groove 122 positioned on an axis 124. The means for attaching this embodiment of the device 110 to a tee is accomplished by configuring the device such that it snaps onto the top of the cup of the tee 60. This alternative embodiment contains a depression 138 on the which the golf ball rests. The feedback mechanism of this embodiment has rounded fins 136 to increase the probability of golf club contact with the feedback extensions which in this embodiment are points 132. The feedback mechanism is symmetrical about the axis 124 and the ends of the feedback extension points 132 lie in a plane normal to the axis.

Figure 7:
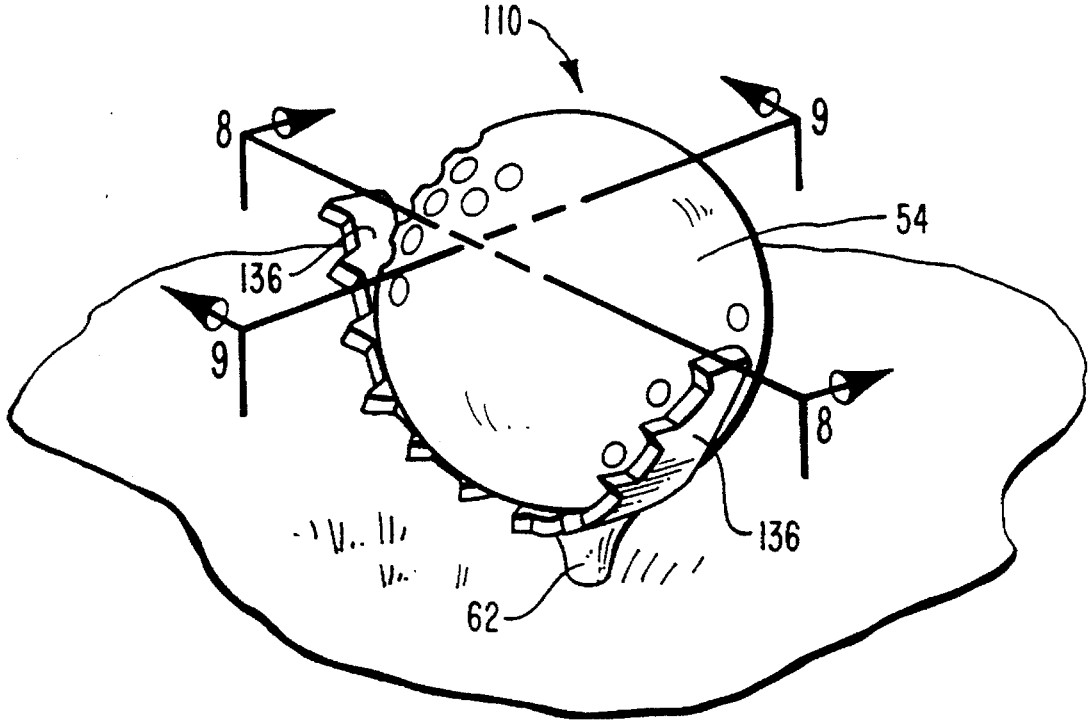
FIG. 7 is a perspective view of the alternative embodiment of FIG. 6 being used with a tee and a golf ball.

FIG. 7 illustrates the embodiment of FIG. 6 connected to a golf tee 62 implanted in the ground with a golf ball 54 resting on the device. The feedback mechanism fins 136 cradle the ball 54 such that a golfer would almost have to miss the ball 54 completely in order to not hit the golf training device 110 with the golf club 52.

Figure 8:
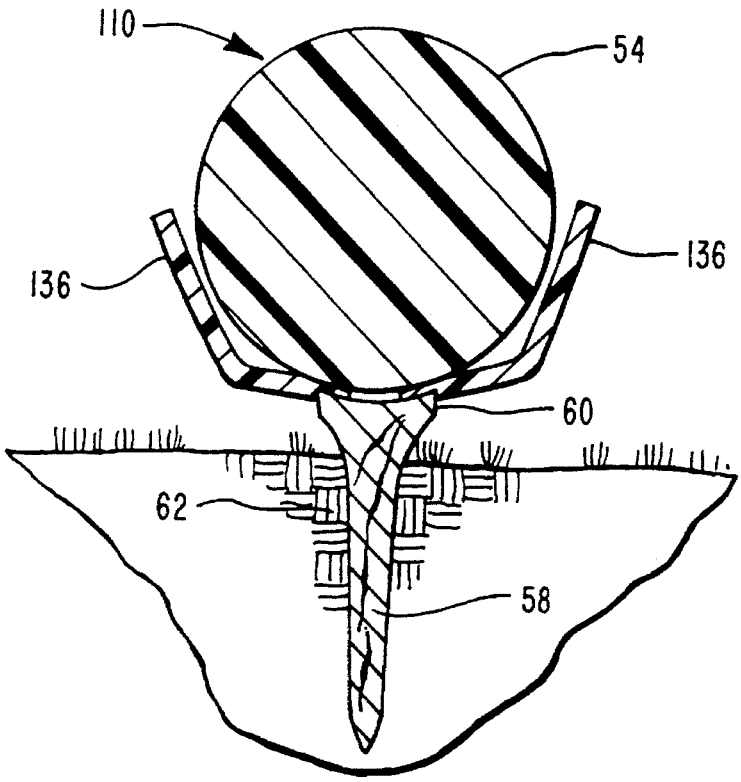
FIG. 8 is a back plan-view of the alternative embodiment of FIG. 7.

The curvature of the fins 136 is best depicted in the cutaway view of FIG. 8. FIG. 8 also illustrates an attachment means by snapping the device 110 to the top of a golf tee cup 60. The golf ball then rests in the depression 138.

Figure 9:
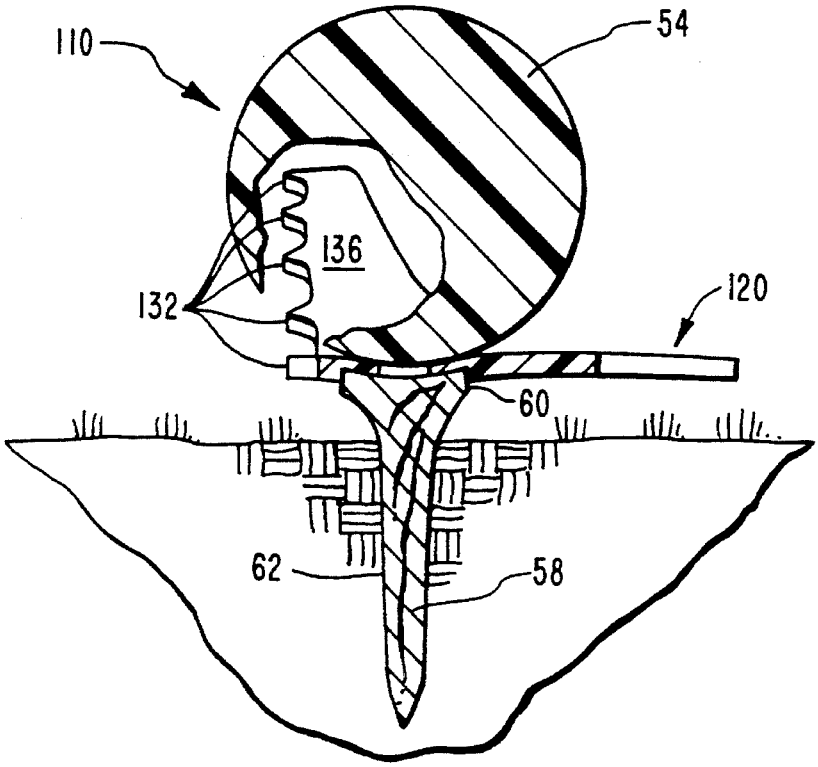
FIG. 9 is a side plan view of the alternative embodiment of FIG. 7.

FIG. 9 illustrates the relationship of the ball 54 to the plane in which the ends of the feedback extension points 132 lie. From this illustration, it is easy to see that if the ball 54 is struck, the feedback extension points 132 will also be struck. FIG. 9 depicts the device 110 snapped onto the cup of a golf tee 60 with the sighting mechanism projections 120 extending toward a preselected target.

The preferred and alternative embodiments of the golf training device illustrated by FIGS. 1 through 9 depict a convenient golf device with a sighting mechanism combined with novel means for providing feedback to the golfer. The advantage of this golf device lies in the improved training provided by an advanced sighting mechanism coupled with a feedback mechanism that will provide a golfer with club position information at the critical moment of impact with the ball. This advantage is provided in a conveniently cost-effective device.

The sighting mechanism allows the user to align a golf shot by holding the device and using an indicator to aim the device at a preselected target. The indicator in one embodiment is a groove akin to a gun site. The indicator is positioned at the end of a projection which points at the target when the golf training device is used in connection with a tee.

The device can be attached to a standard tee in a number of ways. It may be positioned around the shaft of a tee or attached to cup of the tee. Once the device is attached, the tee holds the general position of the device.

With the device properly attached and positioned, and a golf ball in place, the golfer can align the golf club face with the device so that the club will be pointing in the right direction for the golf shot. The device has a series of feedback extensions which are aligned normal to an axis on which sighting mechanism indicator is positioned. Thus, if the face of the club is aligned with the plane in which the ends of the extensions lie, the club will be pointed in the direction of the preselected target.

After the golfer has hit the ball, the feedback extensions, due to their configuration, will necessarily be deformed. An examination of the deformation gives information about the golf club location and angle at the critical moment of impact with the golf ball.

The utility of this device, coupled with the convenience of being light, pocket-sized and usable by right- or left-handed golfers is valuable advancement over conventional devices.

It should be appreciated that the device of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A golf training device comprising:

means for attaching said device to a golf tee, said attachment means configured such that a golf ball may rest on the tee while the tee is attached to the golf training device;

a sighting mechanism for aligning a golf shot; and a feedback mechanism comprising a plurality of outwardly projecting extensions configured such that when the golf training device is struck by a golf club, the angle and location of club impact on the golf training device can be discerned.

2. A golf training device as defined in claim 1, wherein said attachment means comprises an opening disposed within said golf training device.

3. A golf training device as defined in claim 1, wherein the sighting mechanism comprises an outward projection.

4. A golf training device comprising:

means for attaching said device to a golf tee, said means having a substantially circular opening disposed within said device configured such that the shaft of a golf tee may pass through said opening and a golf ball may rest on the tee while the tee is positioned in said opening;

a sighting mechanism comprising an outward projection for aligning a golf shot; and feedback means comprising a plurality of outwardly projecting extensions such that when a golf ball resting on a tee attached to the golf training device is struck by a golf club, said extensions are also struck leaving deformations indicating the angle and location of golf club impact on the golf training device.

5. A golf training device as defined in claim 4, wherein said opening has a diameter larger than the diameter of the shaft of a golf tee, but equal to or smaller than the diameter of the cup of a golf tee.

6. A golf training device as defined in claim 5, wherein the boundary of said opening is at least partially defined by two crescent-shaped prongs.

7. A golf training device as defined in claim 6, wherein said opening has a center positioned on a longitudinal axis.

8. A golf training device as defined in claim 7, wherein said outward projection has a distal end comprising an indicator, said indicator forming a point configured to facilitate aligning said golf device with a target some distance away.

9. A golf training device as defined in claim 8, wherein said point is positioned on said longitudinal axis.

10. A golf training device as defined in claim 4, wherein the indicator at the distal end of the outward projection comprises a groove configured to facilitate aligning said golf device with a target some distance away.

11. A golf training device as defined in claim 10, wherein said groove is positioned on said longitudinal axis.

12. A golf training device as defined in claim 4, wherein said feedback mechanism extensions have ends aligned normally to said longitudinal axis.

13. A golf training device comprising:

a planar piece of compliant material having uniform thickness and a generally triangular shape;

means for attaching said device to a golf tee, comprising a substantially circular opening disposed within said device with a diameter larger than the diameter of the shaft of a golf tee, but equal to or smaller than the diameter of the cup of a golf tee, said opening having its center positioned on a longitudinal axis, said attachment means configured such that a golf ball may rest on the tee while the tee is positioned in said opening;

a sighting mechanism having an outwardly projecting indicator with an end portion positioned on said longitudinal axis and configured to facilitate aligning said golf device with a target some distance away; and a feedback mechanism having a plurality of outwardly projecting prongs with ends aligned normally to said longitudinal axis such that when a golf ball resting on a tee attached to the golf training device is struck by a golf club, said prongs are also struck indicating the angle and location of impact of the club on the golf training device.

14. A golf training device as defined in claim 13, wherein said prongs extend outwardly parallel to the said longitudinal axis.

15. A golf training device as defined in claim 14, wherein the plurality of said prongs possesses symmetry about said longitudinal axis.

16. A golf training device as defined in claim 15, wherein said prongs have substantially equal geometries.

17. A golf training device as defined in claim 16, wherein there are at least two prongs.

18. A golf training device as defined in claim 17, wherein said sighting mechanism forms a distal portion of said golf training device and said feedback mechanism forms a proximal portion of said golf training device.

* * * * *